US011523697B2

(12) United States Patent
Perkins

(10) Patent No.: US 11,523,697 B2
(45) Date of Patent: Dec. 13, 2022

(54) PUMP OPERATED STRAW AND CONTAINER APPARATUS

(71) Applicant: Laurence Perkins, Rochester, NY (US)

(72) Inventor: Laurence Perkins, Rochester, NY (US)

( * ) Notice: Subject to any disclaimer, the term of this patent is extended or adjusted under 35 U.S.C. 154(b) by 401 days.

(21) Appl. No.: 16/837,106

(22) Filed: Apr. 1, 2020

(65) Prior Publication Data

US 2021/0307547 A1 Oct. 7, 2021

(51) Int. Cl.
*A47G 21/18* (2006.01)
*A47G 19/22* (2006.01)

(52) U.S. Cl.
CPC ..... *A47G 21/18* (2013.01); *A47G 19/2266* (2013.01)

(58) Field of Classification Search
CPC .. A47G 21/18; A47G 21/185; A47G 19/2266; A47G 19/2272; B65D 81/3879; A61J 15/0092; A61J 15/0011; A01G 25/145
See application file for complete search history.

(56) References Cited

U.S. PATENT DOCUMENTS 2,969,064 A 1/1961 Metz
4,196,747 A 4/1980 Quigley
4,848,622 A 7/1989 Kroetsch
5,005,717 A * 4/1991 Oilar ..... A47J 41/0005 215/229
5,484,405 A 1/1996 Edstrom
7,207,968 B1 4/2007 Harcinske
8,790,296 B2 7/2014 Makowski
9,346,607 B2 * 5/2016 Madjar ..... A47G 19/2272
9,828,982 B1 * 11/2017 Richardson ..... H01H 3/24
2006/0255169 A1 11/2006 Gieson
2011/0011823 A1 * 1/2011 Moore ..... A47G 19/2266 215/387
2014/0131372 A1 * 5/2014 Hiner ..... B65D 23/104 220/739
2017/0022042 A1 * 1/2017 Lux ..... B67D 1/0082
2018/0362221 A1 * 12/2018 Hooks ..... B65D 85/816
2020/0060458 A1 * 2/2020 Neyhart ..... A47G 23/0225

FOREIGN PATENT DOCUMENTS

WO WO9614821 5/1996

* cited by examiner

*Primary Examiner* — Tuongminh N Pham

(57) ABSTRACT

A pump operated straw and container apparatus for drinking without getting up from a prone position includes a vessel body having a vessel bottom side, a vessel sidewall, and a vessel top side defining a vessel inside. The vessel top side has a fill aperture and a straw aperture extending through to the vessel inside. A cap is selectively engageable within the fill aperture. A straw is coupled to the vessel body. The straw has a pump end coupled within the vessel inside, a flexible straw body extending through the straw aperture, and a mouth end. A pump is coupled to the vessel body within the vessel inside and is in fluid communication with the straw.

7 Claims, 5 Drawing Sheets

PUMP OPERATED STRAW AND CONTAINER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to drink vessels and more particularly pertains to a new drink vessel for drinking without getting up from a prone position.

(2) Description of Related Art Including Information Disclosed Under 37 CFR 1.97 and 1.98

The prior art relates to drink vessels that are usable in a prone position by the injured and disabled. Existing devices are typically gravity fed or involve valve systems to allow the flow of fluid and thus require the vessel to be placed above the user's head. They do not employ an integrated pump to allow the vessel to be placed at any height.

BRIEF SUMMARY OF THE INVENTION

An embodiment of the disclosure meets the needs presented above by generally comprising a vessel body having a vessel bottom side, a vessel sidewall, and a vessel top side defining a vessel inside. The vessel top side has a fill aperture and a straw aperture extending through to the vessel inside. The vessel inside is configured to hold a fluid. A cap is selectively engageable within the fill aperture. A straw is coupled to the vessel body. The straw has a pump end coupled within the vessel inside, a flexible straw body extending through the straw aperture, and a mouth end. A pump is coupled to the vessel body within the vessel inside and is in fluid communication with the straw.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
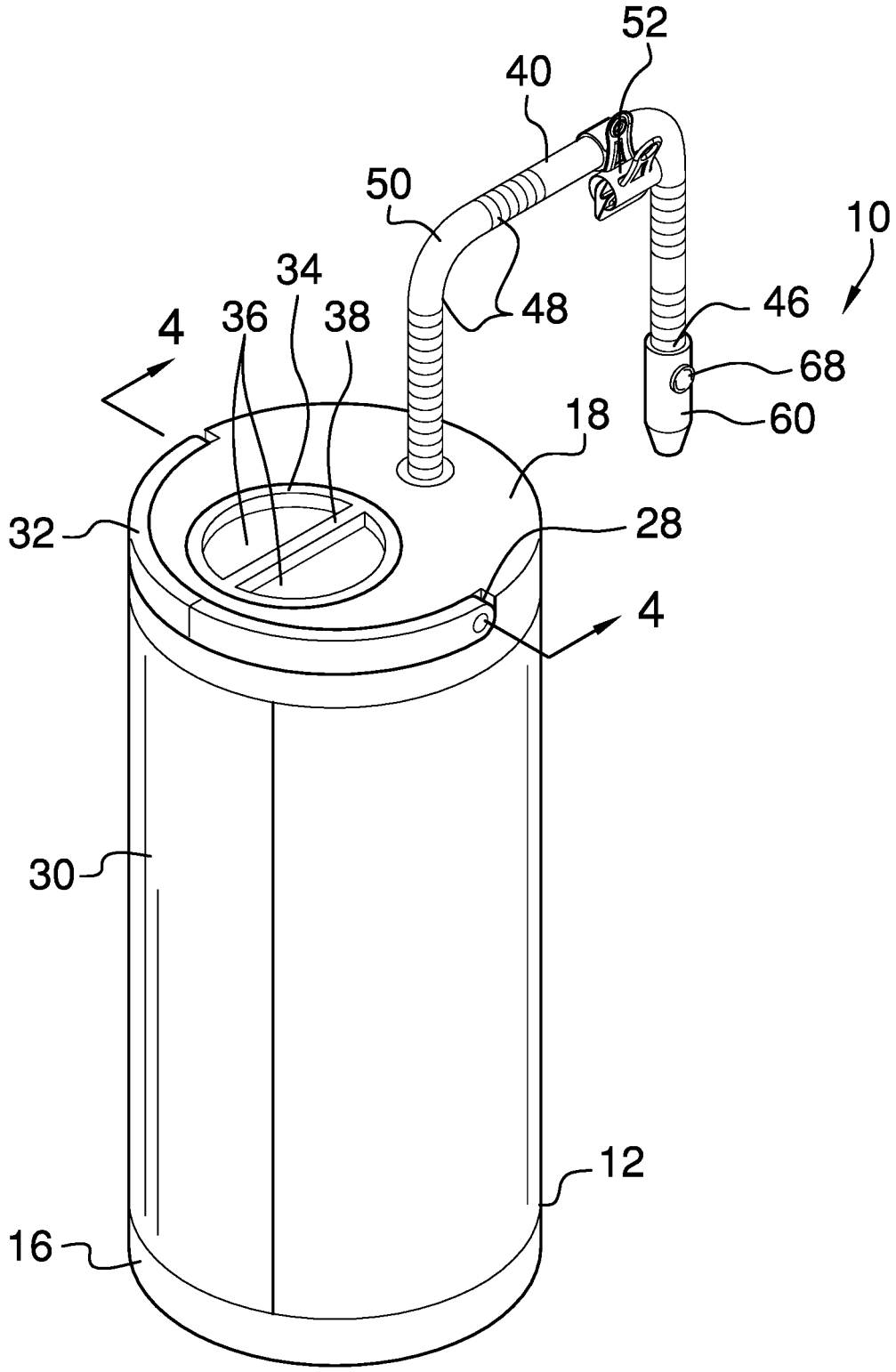
FIG. 1 is an isometric view of a pump operated straw and container apparatus according to an embodiment of the disclosure.
Figure 2:
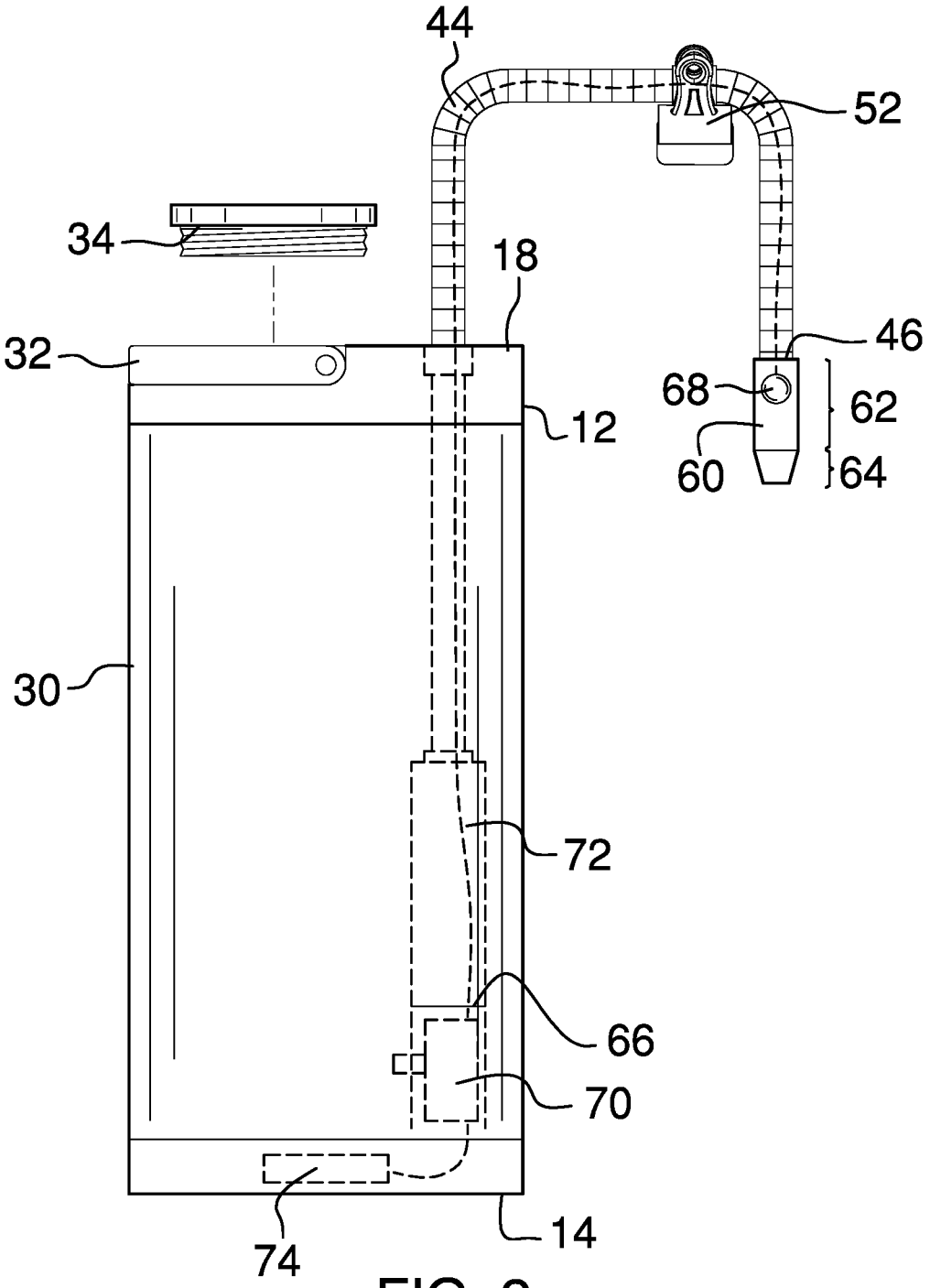
FIG. 2 is a side elevation view of an embodiment of the disclosure.
Figure 3:
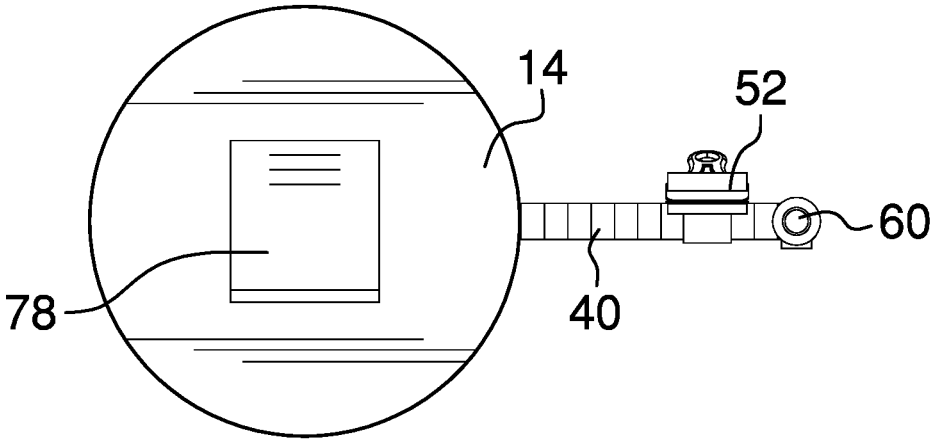
FIG. 3 is a bottom plan view of an embodiment of the disclosure.
Figure 4:
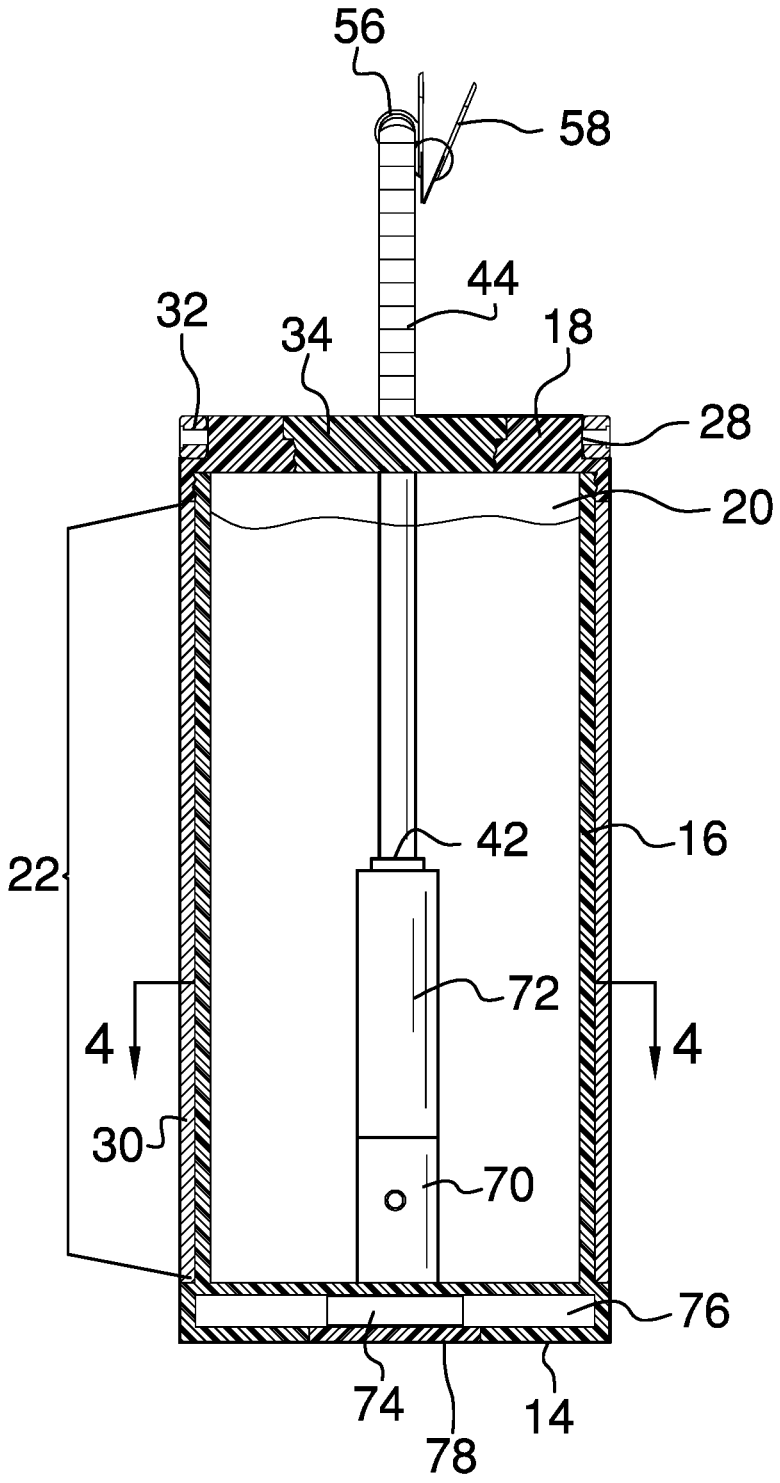
FIG. 4 is a cross-sectional view of an embodiment of the disclosure along the line 4-4 of FIG. 1.
Figure 5:
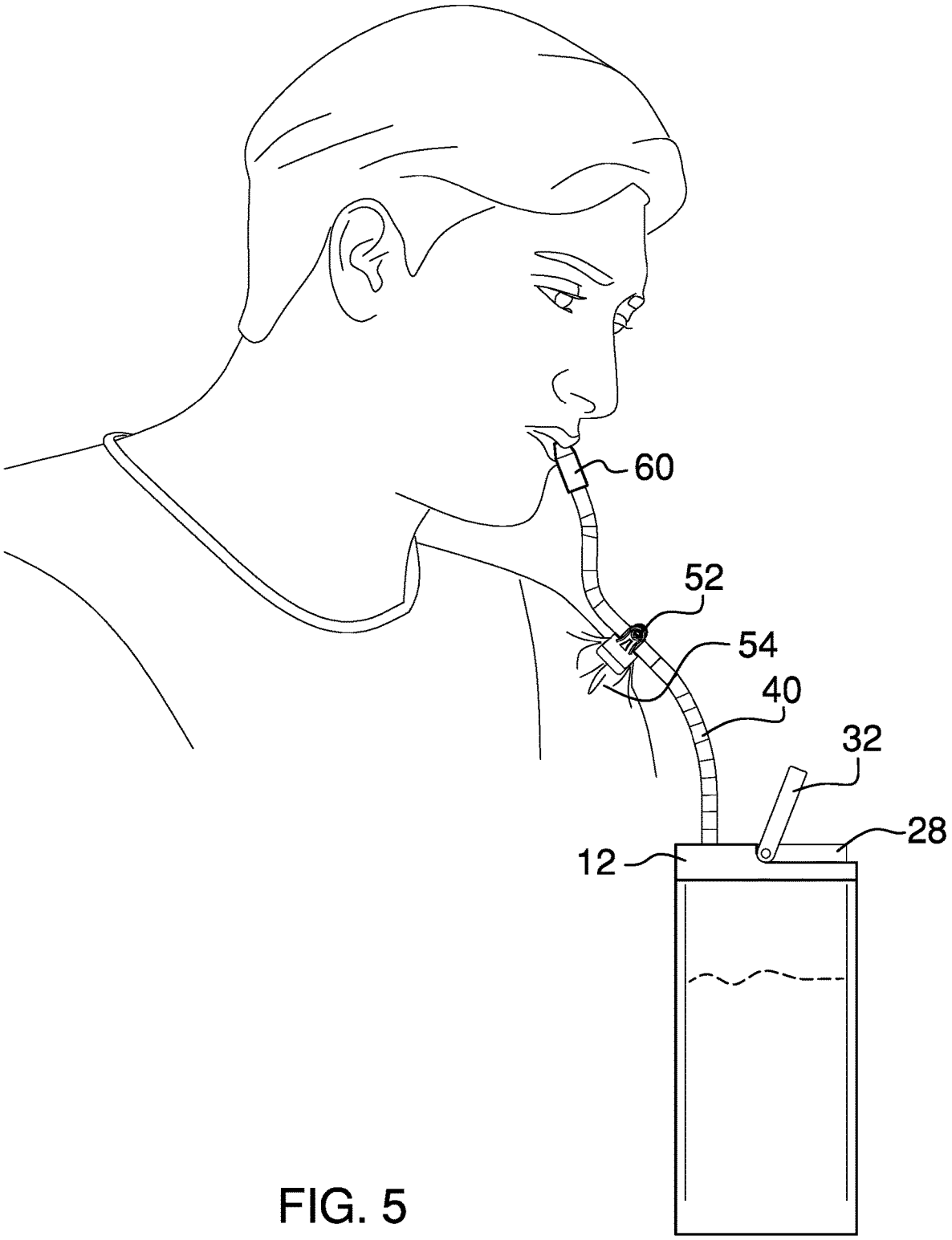
FIG. 5 is an in-use view of an embodiment of the disclosure.

With reference now to the drawings, and in particular to FIGS. 1 through 5 thereof, a new drink vessel embodying the principles and concepts of an embodiment of the disclosure and generally designated by the reference numeral 10 will be described.

As best illustrated in FIGS. 1 through 5, the pump operated straw and container apparatus 10 generally comprises a vessel body 12 having a vessel bottom side 14, a vessel sidewall 16, and a vessel top side 18 defining a vessel inside 20. The vessel sidewall 16 may have an inset portion 22. The vessel top side 18 has a fill aperture 24 and a straw aperture 26 extending through to the vessel inside 20. The vessel top side 18 may be threadably engageable with the vessel sidewall 16 to allow full access to the vessel inside 20. The vessel top side 18 may have a handle recession 28 around half the perimeter thereof. The vessel inside 20 is configured to hold a fluid.

A cylindrical vessel cover 30 may be coupled to the vessel body 12. The vessel cover 30 is coupled to the inset portion 22 of the vessel sidewall and conforms to the vessel bottom side 14 and the vessel top side 18. The vessel cover 30 may be a protective or insulating material such as, but not limited to, stainless steel, plastics, and the like. A handle 32 is pivotably coupled to the vessel top side 18. The handle 32 may be semicircular and conforms to the handle recession 28 to allow it to match the profile of the vessel body 12 when folded down.

A cap 34 is coupled to the vessel body 12 and is selectively engageable within the fill aperture 24. The cap 34 may have a pair of hemispherical depressions 36 defining a twist bar 38 extending across a diameter of the cap 34. The cap 34 thus provides easier access to fill the vessel inside 20 without removing the entire vessel top side 18.

A straw 40 is coupled to the vessel body 12. The straw 40 has a pump end 42 coupled within the vessel inside 20, a flexible straw body 44 extending through the straw aperture 26, and a mouth end 46. The straw body 44 may be entirely flexible or may include a plurality of gooseneck portions 48 and a plurality of elbow portions 50. A clip 52 is coupled to the straw body 44. The clip 52 is configured to attach to a user's shirt 54. The clip 52 may have a rotatable mount portion 56 and a spring-clip portion 58. A mouthpiece 60 is coupled to the mouth end 46 of the straw. The mouthpiece 60 may have a cylindrical portion 62 and a tapered portion 64 for user comfort.

A pump 66 is coupled to the vessel body 12 and may have an activation switch 68 coupled to the cylindrical portion 62 of the mouthpiece. The pump 66 is coupled within the vessel inside 20 and is in fluid communication with the straw 40. The pump 66 may include a pump portion 70, a filter portion 72, and a battery 74. The pump end 42 of the straw is coupled to the filter portion 72 of the pump. The battery 74 may be coupled within a battery compartment 76 of the vessel bottom side 14. The battery compartment 76 has a selectively engageable compartment cover 78 to allow the battery 74 to be easily replaced.

In use, the user fills the vessel inside 20 through the fill aperture 24 and then engages the cap 34. The clip 52 is then attached to the user's shirt 54 to prevent the mouthpiece 60 from straying too far from the user's mouth. To drink, the user places the tapered portion 64 of the mouthpiece in his or her mouth and presses the activation switch 68 to operate the pump 66 and drink without lifting his or her head.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pump operated straw and container apparatus comprising:

a vessel body having a vessel bottom side, a vessel sidewall, and a vessel top side defining a vessel inside, the vessel top side having a till aperture and a straw aperture extending through to the vessel inside, the vessel inside being configured to hold a fluid, the vessel sidewall having an inset portion, the vessel top side being threadably engageable with the vessel sidewall;

a cap coupled to the vessel body, the cap being selectively engageable within the fill aperture;

a straw coupled to the vessel body, the straw having a pump end coupled within the vessel inside, a flexible straw body extending through the straw aperture, and a mouth end;

a mouthpiece coupled to the mouth end of the straw; and a pump coupled to the vessel body, the pump being coupled within the vessel inside and being in fluid communication with the straw, the pump including a pump portion and a filter portion;

a clip coupled to the straw body, the clip being configured to attach to a users shirt;

a handle coupled to the vessel body, the handle being pivotably coupled to the vessel top side; and a cylindrical vessel cover being coupled to the inset portion of the vessel sidewall and conforming to the vessel bottom side and the vessel top side.

2. The pump operated straw and container apparatus of claim 1 further comprising the pump having an activation switch coupled to the mouthpiece.

3. The pump operated straw and container apparatus of claim 1 further comprising the pump having a battery, the battery being coupled within a battery compartment of the vessel bottom side, the battery compartment having a selectively engageable compartment cover.

4. The pump operated straw and container apparatus of claim 1 further comprising the mouthpiece having a cylindrical portion and a tapered portion.

5. The pump operated straw and container apparatus of claim 1 further comprising the vessel top side having a handle recession around half the perimeter, the handle being semicircular and conforming to the handle recession.

6. The pump operated straw and container apparatus of claim 1 thither comprising the cap having a pair of hemispherical depressions defining a twist bar extending across a diameter of the cap.

7. A pump operated straw and container apparatus comprising:

a vessel body having a vessel bottom side, a vessel sidewall, and a vessel top side defining a vessel inside, the vessel sidewall having an inset portion, the vessel top side being threadably engageable with the vessel sidewall, the vessel top side having a fill aperture and a straw aperture extending through to the vessel inside, the vessel top side having a handle recession around half the perimeter, the vessel inside being configured to hold a fluid;

a cylindrical vessel cover coupled to the vessel body, the cylindrical vessel cover being coupled to the inset portion of the vessel sidewall and conforming to the vessel bottom side and the vessel top side;

a handle coupled to the vessel body, the handle being pivotably coupled to the vessel top side, the handle being semicircular and conforming to the handle recession;

a cap coupled to the vessel body, the cap having a pair of hemispherical depressions defining a twist bar extending across a diameter of the cap, the cap being selectively engageable within the fill aperture;

a straw coupled to the vessel body, the straw having a pump end coupled within the vessel inside, a flexible straw body extending through the straw aperture, and a mouth end;

a clip coupled to the straw body, the clip being configured to attach to a user's shirt;

a mouthpiece coupled to the mouth end of the straw, the mouthpiece having a cylindrical portion and a tapered portion; and a pump coupled to the vessel body, the pump having an activation switch coupled to the mouthpiece, the pump being coupled within the vessel inside and being in fluid communication with the straw, the pump including a pump portion, a filter portion, and a battery, the battery being coupled within a battery compartment of the vessel bottom side, the battery compartment having a selectively engageable compartment cover.

* * * * *